US010264366B2

(12) United States Patent
Tu et al.

(10) Patent No.: US 10,264,366 B2
(45) Date of Patent: Apr. 16, 2019

(54) HEARING AID AND METHOD FOR DYNAMICALLY ADJUSTING RECOVERY TIME IN WIDE DYNAMIC RANGE COMPRESSION

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 43 days.

(21) Appl. No.: 15/690,410

(22) Filed: Aug. 30, 2017

(65) Prior Publication Data

US 2018/0115840 A1 Apr. 26, 2018

(30) Foreign Application Priority Data

Oct. 20, 2016 (TW) ..... 105133838 A

(51) Int. Cl.
*H04R 25/00* (2006.01)

(52) U.S. Cl.
CPC ..... *H04R 25/505* (2013.01); *H04R 25/356* (2013.01); *H04R 2225/43* (2013.01)

(58) Field of Classification Search
CPC ..... H04R 25/536; H04R 25/505; H04R 2225/43
See application file for complete search history.

(56) References Cited

U.S. PATENT DOCUMENTS 4,718,099 A * 1/1988 Hotvet ..... H03G 3/32 381/106
5,144,675 A * 9/1992 Killion ..... H03G 7/002 330/254
5,832,444 A * 11/1998 Schmidt ..... G10L 19/265 704/500

(Continued)

OTHER PUBLICATIONS

Killion, Mead C. "Hearing aids: Past, present, future: Moving toward." British Journal of Audiology 31 (1997): 141-148. (Year: 1997).*

(Continued)

*Primary Examiner* — Jialong He
(74) *Attorney, Agent, or Firm* — McClure, Qualey & Rodack, LLP

(57) ABSTRACT

A method for dynamically adjusting recovery time in wide dynamic range compression (WDRC) for use in a hearing aid is provided. The method includes the steps of: receiving an input signal via the hearing aid; applying a band-pass filter on the input acoustic signal to calculate a high-energy ratio; calculating an over-zero rate ratio corresponding to the input acoustic signal; calculating a consonant occurring probability according to the high-frequency energy ratio and the over-zero rate ratio; applying a consonant determination mechanism on the input acoustic signal, and adjusting the consonant occurring probability according to the results of the consonant determination mechanism; calculating a recovery time factor corresponding to the input acoustic signal according to the adjusted consonant occurring probability; and performing a WDRC process on the input acoustic signal according to the recovery time factor to generate an output acoustic signal.

10 Claims, 3 Drawing Sheets

(56) References Cited

U.S. PATENT DOCUMENTS

| | | | | |
|---|---|---|---|---|
| 6,004,015 | A * | 12/1999 | Watanabe | G06F 17/505 700/28 |
| 6,993,480 | B1 * | 1/2006 | Klayman | G10L 21/0364 704/225 |
| 2005/0147262 | A1 * | 7/2005 | Breebaart | H03G 7/007 381/106 |
| 2009/0018826 | A1 * | 1/2009 | Berlin | G10L 15/07 704/223 |
| 2009/0287492 | A1 * | 11/2009 | Chalupper | H03G 9/005 704/500 |
| 2015/0358743 | A1 * | 12/2015 | Killion | H04L 27/04 381/323 |

OTHER PUBLICATIONS

Moore, Brian CJ. "The choice of compression speed in hearing aids: Theoretical and practical considerations and the role of individual differences." Trends in Amplification 12.2 (2008): 103-112. (Year: 2008).*

Giannoulis, Dimitrios, Michael Massberg, and Joshua D. Reiss. "Digital dynamic range compressor design—A tutorial and analysis." Journal of the Audio Engineering Society 60.6 (2012): 399-408. (Year: 2012).*

Jenstad, Lorienne M., and Pamela E. Souza. "Quantifying the effect of compression hearing aid release time on speech acoustics and intelligibility." Journal of Speech, Language, and Hearing Research 48.3 (2005): 651-667. (Year: 2005).*

* cited by examiner

HEARING AID AND METHOD FOR DYNAMICALLY ADJUSTING RECOVERY TIME IN WIDE DYNAMIC RANGE COMPRESSION

CROSS REFERENCE TO RELATED APPLICATIONS

This Application claims priority of Taiwan Patent Application No. 105133838, filed on Oct. 20, 2016, the entirety of which is incorporated by reference herein.

BACKGROUND OF THE INVENTION

Field of the Invention

The present invention relates to hearing aids, and, in particular, to a hearing aid and an associated method for dynamically adjusting recovery time in wide dynamic range compression (WDRC).

Description of the Related Art

Techniques for wide dynamic range compression (WDRC) are widely used in hearing aids. After long-term research, the activation time around 5 ms used in a hearing aid may fit the needs of most hearing-impaired people, but the recovery time may vary depending on different environments. FIG. 3 is a diagram of a hearing compensation curve of an input acoustic signal after WDRC. Curve 310 represents the transition curve of an unprocessed input acoustic signal. Curve 320 represents the transition curve of a processed input acoustic signal by WDRC, and FIG. 3 can be roughly divided into four regions 331~334. The strength of an acoustic signal can be expressed by a sound pressure level in units of dB (i.e. dB SPL).

Region 331 is a high linear region (e.g. over 90 dB SPL), and it indicates that a hearing-impaired person has the same saturated sound pressure as that of common people, and the input acoustic signal in region 331 should not be amplified. Region 332 indicates a compression region (e.g. between 55~90 dB SPL), and is used for adjusting the dynamic range of the user's audible area. Region 333 indicates a low linear region (e.g. between 40~55 dB SPL), and is used for amplifying a weak speech acoustic signal. Region 334 indicates an expansion region (e.g. lower than 40 dB SPL). Because the strength of the acoustic signal in region 334 may be very weak, the input acoustic signal may be noise signals that are weaker than a speech acoustic signal, and thus the input acoustic signal in region 334 should not be amplified too much. Additionally, there is also a volume limiter at the output terminal of the hearing aid for limiting the maximum volume of the output acoustic signal, for example, limiting the output volume to within 110 dB SPL.

The duration between the first time that the amplitude of the input acoustic signal suddenly increases to a predefined decibel value and the second time that the amplitude of the output acoustic signal of the hearing aid has been increased to a stable sound pressure level can be regarded as the "activation time". However, the duration between the third time that the amplitude of the input acoustic signal is decreased to a lower dB value from a higher dB value and the fourth time that the amplitude of the output acoustic signal of the hearing aid has been decreased to a stable sound pressure level can be regarded as the "recovery time".

The activation time and recovery time in a conventional hearing aid are set to a fixed value. If the fixed value of the recovery time is smaller (e.g. 50 ms) and the interval between vowels and consonants is longer in the speech acoustic signal from a speaker, the noises between vowels and consonants will also be amplified, resulting in discomfort on the part of the hearing-impaired user. If the fixed value of the recovery time is longer (e.g. 150 ms) and the interval between vowels and consonants is shorter in the speech acoustic signal from a speaker, the consonants that are expected to be amplified cannot be amplified in time, resulting in poor speech recognition by the hearing-impaired user.

Accordingly, there is demand for a hearing aid and an associated method for dynamically adjusting recovery time in wide dynamic range compression (WDRC).

BRIEF SUMMARY OF THE INVENTION

A detailed description is given in the following embodiments with reference to the accompanying drawings.

In an exemplary embodiment, a hearing aid is provided. The hearing aid includes a microphone, a speaker, and an acoustic processing circuit. The microphone is for receiving an input acoustic signal. The acoustic processing circuit is for applying a band-pass filter on the input acoustic signal to calculate a high-frequency energy ratio, calculating an over-zero rate ratio corresponding to the input acoustic signal, and calculating a consonant occurring probability according to the high-frequency energy ratio and the over-zero rate ratio. The acoustic processing circuit further applies a consonant determination mechanism on the input acoustic signal, and adjusts the consonant occurring probability according to a result of the consonant determination mechanism. The acoustic processing circuit further calculates a recovery time factor corresponding to the input acoustic signal according to the adjusted consonant occurring probability, and performs a wide dynamic range compression (WDRC) process on the input acoustic signal according to the recovery time factor to generate an output acoustic signal to be played on the speaker.

In another exemplary embodiment, a method for dynamically adjusting recovery time in wide dynamic range compression (WDRC) for use in a hearing aid is provided. The method includes the steps of: receiving an input signal by the hearing aid; applying a band-pass filter on the input acoustic signal to calculate a high-energy ratio; calculating an over-zero rate ratio corresponding to the input acoustic signal; calculating a consonant occurring probability according to the high-frequency energy ratio and the over-zero rate ratio; applying a consonant determination mechanism on the input acoustic signal, and adjusting the consonant occurring probability according to a result of the consonant determination mechanism; calculating a recovery time factor corresponding to the input acoustic signal according to the adjusted consonant occurring probability; and performing a wide dynamic range compression (WDRC) process on the input acoustic signal according to the recovery time factor to generate an output acoustic signal to be played on a speaker of the hearing aid.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
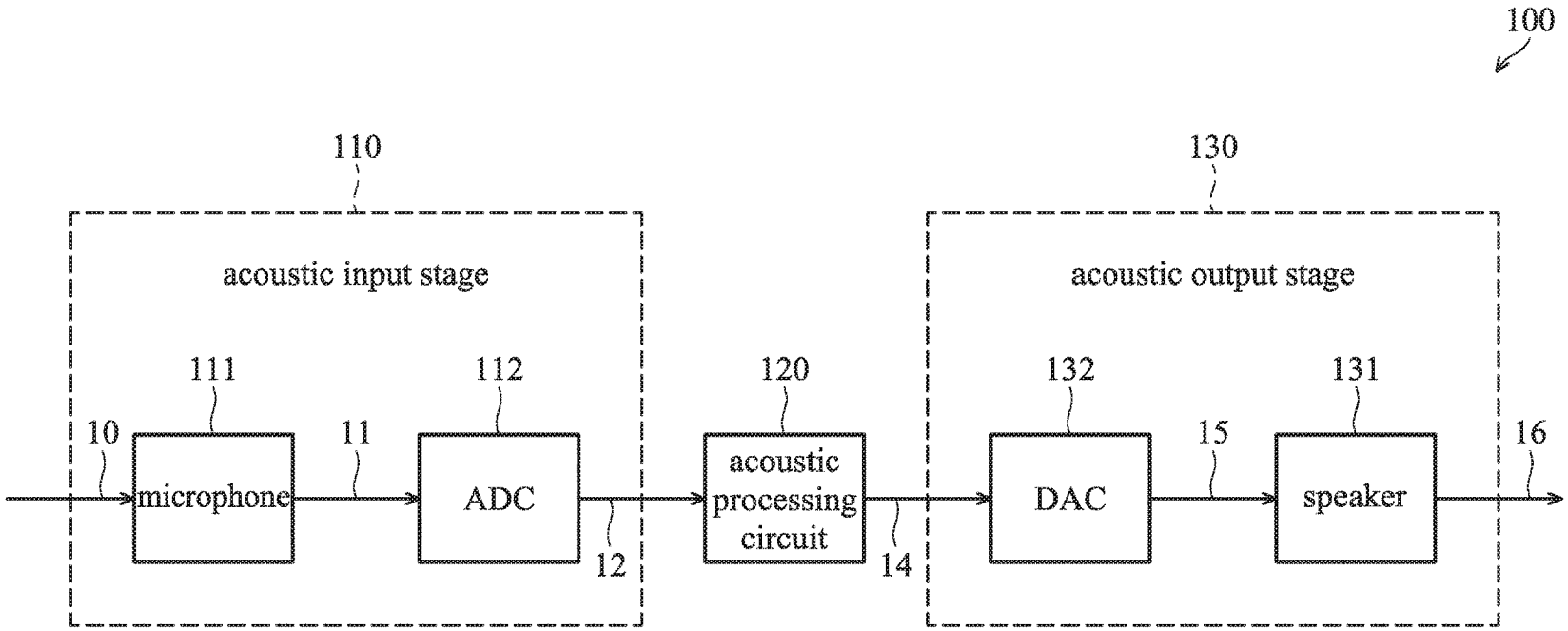
FIG. 1 is a schematic block diagram of a hearing aid in accordance with an embodiment of the invention.

FIG. 1 is a schematic block diagram of a hearing aid in accordance with an embodiment of the invention. In an embodiment, the hearing aid 100 includes an acoustic input stage 110, an acoustic processing circuit 120, and an acoustic output stage 130. The acoustic input stage 110 includes a microphone 111 and an analog-to-digital converter (ADC) 112. The microphone is for receiving an input acoustic signal 10 (e.g. an analog acoustic signal), and convert the input acoustic signal 10 into an input electrical signal 11. The ADC 112 converts the input electrical signal 11 to an input digital signal 12 as the input of the acoustic processing circuit 120.

The acoustic processing circuit 120 performs a wide dynamic range compression process on the input digital signal 12 to generate an output digital output signal 14. It should be noted that the aforementioned WDRC process includes a predetermined WDRC transition curve that is designed for the hearing characteristics of a specific user. For example, various tests for different hearing volumes and frequencies are performed in advance, thereby obtaining the WDRC transition curve for the specific user. In addition, when the amplitude of the input acoustic signal changes, the acoustic processing circuit 120 may also adjust the recovery time of the hearing aid 100 correspondingly, thereby providing a better user experience for the hearing-impaired user. In some embodiments, the acoustic processing circuit 120 may be a microcontroller, a processor, a digital signal processor (DSP), or an application-specific integrated circuit (ASIC), but the invention is not limited thereto.

Specifically, while performing the WDRC process, the acoustic processing circuit 120 may adjust the delay time of the output acoustic signal (i.e. recovery time) with reference to the recovery time factor associated with the input acoustic signal, and details of the adjustment will be described in the embodiment of FIG. 2. The acoustic output stage 130 includes a receiver or speaker 131 and a digital-to-analog converter (DAC) 132. The DAC 132 is configured to convert the output digital signal 14 from the acoustic processing circuit 120 to an output electrical signal 15. The speaker 131 converts the output electrical signal 15 into an output acoustic signal 16 that is played by the speaker 131. For the purposes of description, in the following embodiments, the conversion between the acoustic signals and electrical signal are omitted, and only the input acoustic signal and output acoustic signal are used.

Figure 2:
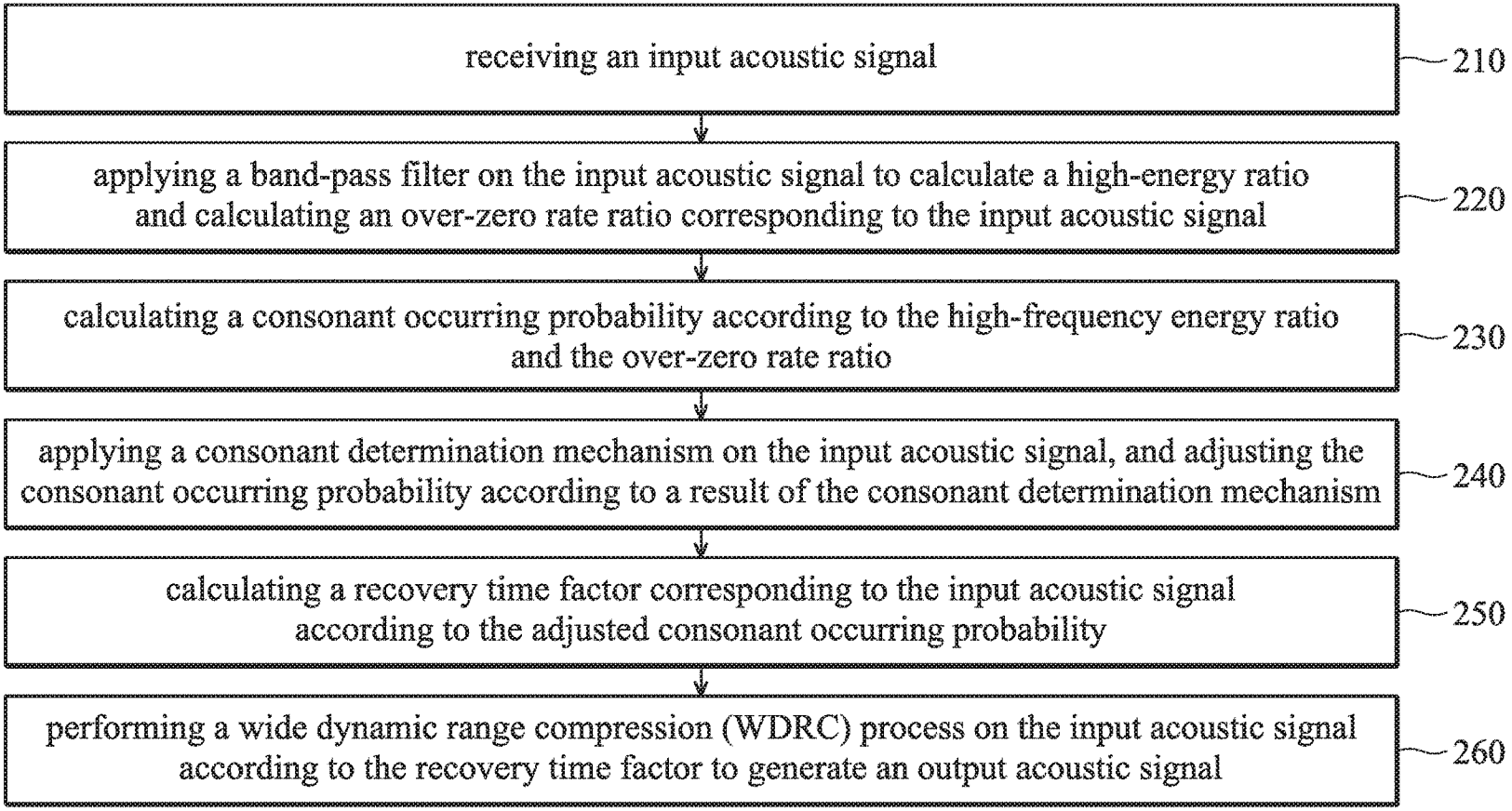
FIG. 2 is a flow chart of a method for dynamically adjusting recovery time in wide dynamic range compression (WDRC) in accordance with an embodiment of the invention.
Figure 3:
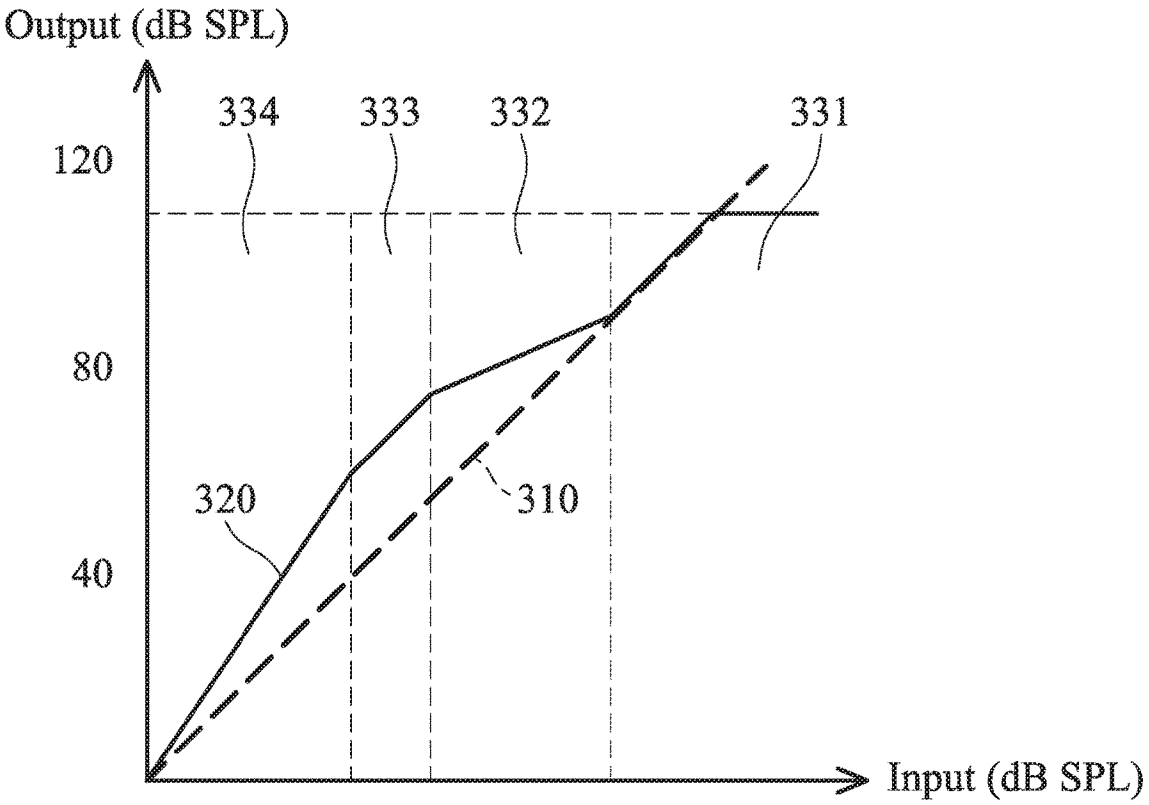
FIG. 3 is a diagram of a hearing compensation curve of an input acoustic signal after WDRC.

FIG. 2 is a flow chart of a method for dynamically adjusting recovery time in wide dynamic range compression (WDRC) in accordance with an embodiment of the invention.

In block 210, an input acoustic signal is received by the microphone 111.

In block 220, the acoustic processing circuit 120 applies a band-pass filter on the input acoustic signal to calculate the high-frequency energy $E_{high}$, total energy $E_{low}$, and an over-zero rate ratio, and calculates an estimated over-zero rate $Z_R$.

Specifically, the input acoustic signal may be a sinusoidal wave, and the amplitude and phase of the sinusoidal wave may vary from time to time. The acoustic processing circuit 120 may count the number that the amplitude of the input acoustic signal change to a positive value from a negative value within a predetermined time, thereby obtaining the estimated over-zero rate $Z_R$.

Then, the acoustic processing circuit 120 calculates a high-frequency energy ratio $E_P$, wherein the high-frequency energy ratio $E_P$ can be expressed by the following equation:

$$E_P=E_{high}/E_{total}.$$

Additionally, the acoustic processing circuit 120 further defines a standard over-zero rate $Z_s$. For example, the standard over-zero rate can be set to a fixed value based on experience and practical conditions. Afterwards, the acoustic processing circuit 120 calculates an over-zero rate ratio $Z_p$, wherein the over-zero rate ratio $Z_p$ can be expressed by the following equation:

$$Z_p = \begin{cases} \frac{Z_R}{Z_S}, & Z_R < Z_S \\ 1, & Z_R \geq Z_S \end{cases}$$

In block 230, the acoustic processing circuit 120 calculates a consonant occurring probability of the input acoustic signal according to the over-zero rate ratio $Z_p$ and the high-frequency energy ratio $E_P$. Specifically, while performing a consonant determination process, the acoustic processing circuit 120 calculates the consonant occurring probability with the following equation:

$$P_{EZ}=E_P \cdot Z_P, \text{ where } 0 \leq P_{EZ} \leq 1.$$

In block 240, the acoustic processing circuit 120 adjusts the consonant occurring probability according to a consonant determination mechanism:

$$P_{EZ} = \begin{cases} P_{EZ}, & \text{determined as a consonant} \\ 0, & \text{determined as a non-consonant} \end{cases}$$

In block 250, the acoustic processing circuit 120 calculates a recovery time factor (e.g. $\beta_x$) associated with the input acoustic signal according to the result of the consonant determination mechanism. For example, the aforementioned consonant determination mechanism may utilize well-known consonant determination techniques in the time domain to determine whether the input acoustic signal includes consonants or noises.

For example, the recovery time factor $\beta_x$ can be defined as:

$$\beta=a+P_{EZ}*b$$

wherein a and b can be positive or negative numbers. Generally, the frequency of a consonant is relatively high, and the frequency of a vowel is relatively low. However, a noise signal may be a high-frequency signal. When the consonant occurring probability $P_{EZ}=0$, it indicates that the acoustic processing circuit 120 determines the input acoustic signal as noises. Meanwhile, the recovery time factor $\beta=a$, and the corresponding recovery time is 150 ms, where the recovery time factor can be defined as $\beta_{150}$. When the consonant occurring probability $P_{EZ}=0$, it indicates that the acoustic processing circuit 120 determines the input acoustic signal as a consonant. Meanwhile, the recovery time factor $\beta=a+b$, and the corresponding recovery time is 50 ms, wherein the recovery time factor can be defined as $\beta_{50}$.

It should be understood that the recovery times corresponding to the recovery time factors $\beta_{150}$ and $\beta_{50}$ indicate the upper limit (150 ms) and the lower limit (50 ms) of the recovery time, respectively. According to the variation of the consonant occurring probability $P_{EZ}$ and the result of the consonant determination mechanism, the recovery time factor $\beta x$ calculated by the acoustic processing circuit 120 may also vary within the range from $\beta_{150}$ to $\beta_{50}$.

In block 260, the acoustic processing circuit 120 may perform a WDRC process on the input acoustic signal according to the calculated recovery time factor and a predetermined hearing compensation curve to generate an output acoustic signal.

Specifically, the recovery time of the output acoustic signal corresponds to the recovery time factor of the input acoustic signal. The WDRC method in the present application may dynamically adjust the recovery time of the hearing aid according to the characteristics of the speech acoustic signal from the speaker. When the interval between a vowel and a consonant in the speech acoustic signal from the speaker is longer, the recovery time may be adjusted correspondingly longer, and the gain of the noises will also be decreased. When the interval between a vowel and a consonant in the speech acoustics signal from the speaker is shorter, the recovery time may be adjusted correspondingly shorter, thereby increasing the gain of a consonant for better speech recognition for the hearing-impaired user.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A hearing aid, comprising:

a microphone, for receiving an input acoustic signal;

a speaker; and an acoustic processing circuit, for applying a band-pass filter on the input acoustic signal to calculate a high-frequency energy ratio, calculating an over-zero rate ratio corresponding to the input acoustic signal, and calculating a consonant occurring probability according to the high-frequency energy ratio and the over-zero rate ratio, wherein the acoustic processing circuit further applies a consonant determination mechanism on the input acoustic signal, and adjusts the consonant occurring probability according to a determination result of the consonant determination mechanism about whether the input acoustic signal comprising a consonant or noise, wherein the acoustic processing circuit further calculates a recovery time factor corresponding to the input acoustic signal according to the adjusted consonant occurring probability, and performs a wide dynamic range compression (WDRC) process on the input acoustic signal according to the recovery time factor to generate an output acoustic signal to be played on the speaker.

2. The hearing aid as claimed in claim 1, wherein the acoustic processing circuit calculates a high-frequency energy and a total energy of the input acoustic signal using the band-pass filter, and calculates the high-frequency energy ratio by dividing the high-frequency energy by the total energy.

3. The hearing aid as claimed in claim 1, wherein the acoustic processing circuit calculates an estimated over-zero rate of the input acoustic signal, and sets a standard over-zero rate, wherein when the estimated over-zero rate is lower than the standard over-zero rate, the acoustic processing circuit calculates the over-zero rate ratio by dividing the estimated over-zero rate by the standard over-zero rate, wherein when the estimated over-zero rate is greater than or equal to the standard over-zero rate, the acoustic processing circuit sets the over-zero rate ratio to 1.

4. The hearing aid as claimed in claim 1, wherein the acoustic processing circuit further calculates the consonant occurring probability by multiplying the high-frequency energy ratio with the over-zero rate ratio, wherein when the result of the consonant determination mechanism indicates that the input acoustic signal is a consonant, the acoustic processing circuit sets an adjusted consonant occurring probability to the consonant occurring probability, wherein when the result of the consonant determination mechanism indicates that the input acoustic signal is not a consonant, the acoustic processing circuit sets an adjusted consonant occurring probability to 0.

5. The hearing aid as claimed in claim 1, wherein the acoustic processing circuit calculates the recovery time factor according to the adjusted consonant occurring probability, and performs the WDRC process on the input acoustic signal according to the recovery time factor to adjust recovery time of the input acoustic signal, thereby generating the output acoustic signal.

6. A method for dynamically adjusting recovery time in wide dynamic range compression (WDRC) for use in a hearing aid, the method comprising:

receiving an input acoustic signal by the hearing aid;

applying a band-pass filter on the input acoustic signal to calculate a high-frequency energy ratio;

calculating an over-zero rate ratio corresponding to the input acoustic signal;

calculating a consonant occurring probability according to the high-frequency energy ratio and the over-zero rate ratio;

applying a consonant determination mechanism on the input acoustic signal, and adjusting the consonant occurring probability according to a determination result of the consonant determination mechanism about whether the input acoustic signal comprising a consonant or noise;

calculating a recovery time factor corresponding to the input acoustic signal according to the adjusted consonant occurring probability; and performing a wide dynamic range compression (WDRC) process on the input acoustic signal according to the recovery time factor to generate an output acoustic signal to be played on a speaker of the hearing aid.

7. The method as claimed in claim 6, further comprising:

calculating a high-frequency energy and a total energy of the input acoustic signal using the band-pass filter; and calculating the high-frequency energy ratio by dividing the high-frequency energy by the total energy.

8. The method as claimed in claim 6, further comprising:

calculating an estimated over-zero rate of the input acoustic signal and setting a standard over-zero rate;

when the estimated over-zero rate is lower than the standard over-zero rate, calculating the over-zero rate ratio by dividing the estimated over-zero rate by the standard over-zero rate; and when the estimated over-zero rate is greater than or equal to the standard over-zero rate, setting the over-zero rate ratio to 1.

9. The method as claimed in claim 6, further comprising:

calculating the consonant occurring probability by multiplying the high-frequency energy ratio with the over-zero rate ratio;

when the result of the consonant determination mechanism indicates that the input acoustic signal is a consonant, setting an adjusted consonant occurring probability to the consonant occurring probability; and wherein when the result of the consonant determination mechanism indicates that the input acoustic signal is not a consonant, setting an adjusted consonant occurring probability to 0.

10. The method as claimed in claim 6, further comprising:

calculating the recovery time factor according to the adjusted consonant occurring probability; and performing the WDRC process on the input acoustic signal according to the recovery time factor to adjust recovery time of the input acoustic signal, thereby generating the output acoustic signal.

* * * * *